US009339061B2

(12) United States Patent
Meyer

(10) Patent No.: US 9,339,061 B2
(45) Date of Patent: May 17, 2016

(54) METHOD AND APPARATUS FOR SMOKING AND DRINKING

(75) Inventor: Jonathan Meyer, Saratoga Springs, NY (US)

(73) Assignee: Meyer Enterprises, Saratoga, NY (US)

( * ) Notice: Subject to any disclaimer, the term of this patent is extended or adjusted under 35 U.S.C. 154(b) by 1005 days.

(21) Appl. No.: 13/471,661

(22) Filed: May 15, 2012

(65) Prior Publication Data

US 2013/0239982 A1 Sep. 19, 2013

Related U.S. Application Data

(60) Provisional application No. 61/610,026, filed on Mar. 13, 2012.

(51) Int. Cl.

| | |
|---|---|
| ***A24F 15/10*** | (2006.01) |
| ***A24F 13/12*** | (2006.01) |
| ***A24F 13/00*** | (2006.01) |

(52) U.S. Cl.

CPC ..... *A24F 13/12* (2013.01); *A24F 13/00* (2013.01); *A24F 15/10* (2013.01)

(58) Field of Classification Search

CPC ..... A24F 13/12; A24F 15/08; A24F 15/18; A24F 13/24; A24F 15/10; A24F 3/00; A24F 1/30; A24F 1/00; A47G 19/2205; A47G 19/22

See application file for complete search history.

(56) References Cited

U.S. PATENT DOCUMENTS

| | | | | |
|---|---|---|---|---|
| 4,164,230 | A | 8/1979 | Pearlman | |
| 4,236,539 | A | 12/1980 | Mosby, Jr. | |
| 4,790,332 | A | 12/1988 | Wallace | |
| 5,353,814 | A | 10/1994 | Martin | |
| 5,388,595 | A | 2/1995 | Shafer | |
| 5,469,870 | A | 11/1995 | Meador | |
| 5,497,791 | A | 3/1996 | Bowen et al. | |
| 5,752,527 | A | 5/1998 | Bowen et al. | |
| 8,485,200 | B1 * | 7/2013 | Levinger | A24F 13/24 131/248 |
| 2008/0060664 | A1 | 3/2008 | Richards | |

FOREIGN PATENT DOCUMENTS

| | | | |
|---|---|---|---|
| GB | 267373 | * | 3/1927 |

* cited by examiner

*Primary Examiner* — Linda L Gray
(74) *Attorney, Agent, or Firm* — Dale J. Ream

(57) ABSTRACT

A smoking and drinking apparatus includes a body member defining an air chamber. A drink reservoir is situated in the air chamber defining a liquid impermeable drink chamber. The drink reservoir is inwardly displaced from the body member to form an air chamber therebetween. A bezel is mounted to the upper edge of the body member that defines a bore in communication with the inner reservoir. The bezel includes an inhalation port through which air is selectively inhaled from the air chamber and an exhalation port through which air is selectively exhaled by a user into the air chamber. The inhalation port is configured to receive a cigarette into the air chamber. A lighting element is positioned in the air chamber for lighting the cigarette when energized. A filter and fan assembly are positioned in the air chamber to filter and exhaust air from the air chamber.

8 Claims, 7 Drawing Sheets

METHOD AND APPARATUS FOR SMOKING AND DRINKING

REFERENCE TO RELATED APPLICATIONS

This application is a non-provisional patent application relating to Provisional patent application Ser. No. 61/610,026 filed Mar. 13, 2012 and titled Drinking and Smoking Apparatus, the provisional patent application being incorporated herein by reference.

BACKGROUND OF THE INVENTION

This invention relates generally to a device for smoking and, more particularly, to a method and apparatus for smoking and drinking that enables a person to smoke a cigarette without exhausting any cigarette smoke into the ambient air and which also enables the person to selectively consume a beverage.

In recent years, smoking cigarettes in public places such as restaurants, airplanes, or even in vehicles with other passengers has become inconvenient, culturally unpopular, or even unlawful. Smoking in public places, workplaces, or even at sporting venues has been curtailed, regulated, or prohibited largely because of the dangers of second hand smoke. Smoking bans often require a smoker to excuse himself from friends, coworkers, or family and stand outside for a "smoke break" which is sometimes undesirable because of bad weather or sometimes results in missing important events.

Various devices have been proposed in the art for collecting smoke from a lit cigarette in a sealed container or filter so as to minimize or eliminate smoke from having negative effects on nearby persons and, in some cases, from even being perceived by other persons. For instance, U.S. Pat. No. 4,236,539 is directed to a smoking apparatus that collects smoke exhaled into it while having the appearance of a traditional beverage container. In other words, persons in the proximity of the beverage container may be unaware that a cigarette is being smoked so long as the user carefully exhales into the clandestine cup.

Although assumably effective for their intended purposes, the existing devices are not useful for holding or dispensing an actual beverage. In other words, the smoking apparatus disclosed in the '539 patent does not include a structure for holding a beverage but rather just mimics the appearance of a beverage container. The '539 device, therefore, is not effective either to convince nearby people that an actual beverage is in the smoking device or to actually provide a beverage to the consumer.

Therefore, it would be desirable to have a smoking and drinking apparatus that contains and dispenses a beverage as well as that enables a user to smoke without emitting any smoke into the ambient air. Further, it would be desirable to have a smoking and drinking apparatus in which a user may inhale air from a lit cigarette while the cigarette is concealed within the apparatus and then, to exhale the inhaled smoke back into the apparatus without being perceived to be smoking at all.

SUMMARY OF THE INVENTION

A smoking and drinking apparatus according to the present invention includes a body member having a continuous side wall defining an interior area, the body member continuous side wall having upper and lower edges defining an open top and an open bottom, respectively. A drink reservoir is situated in the body member having a bottom wall and an drink reservoir continuous side wall extending upwardly from the bottom wall, the drink reservoir side wall having an upper edge defining an open top. The drink reservoir bottom wall and side wall define a water impermeable drink chamber. The drink reservoir side wall is inwardly displaced from the side wall of the body member such that an air chamber is formed therebetween.

A bezel is mounted to the upper edge of the body member side wall that defines a bore in communication with the inner reservoir. A lid may be removably coupled to upper edges of the drink reservoir. The bezel includes an inhalation port through which air is selectively inhaled from the air chamber and an exhalation port through which air is selectively blown into the air chamber by a user. The inhalation port includes a configuration to receive a cigarette into the air chamber. A heating element is positioned in the air chamber and configured to light the cigarette when energized. A filter and fan assembly are situated in the air chamber and configured to draw air from the air chamber through the filter. The apparatus may include a lower body member defining vents through which filtered air is exhausted from the air chamber.

Therefore, a general object of this invention is to provide a smoking and drinking apparatus with which a user may smoke a cigarette without the perception of surrounding people or consume a beverage.

Another object of this invention is to provide the smoking and drinking apparatus, as aforesaid, in which a user may inhale smoke from a lit cigarette that is housed within the apparatus and concealed from view.

Still another object of this invention is to provide the smoking and drinking apparatus, as aforesaid, in which the user may exhale smoke inhaled from the cigarette back into the apparatus.

Yet another object of this invention is to provide the smoking and drinking apparatus, as aforesaid, which is configured to contain a beverage and which segregates the stored beverage from smoke from a lit cigarette.

A further object of this invention is to provide the smoking and drinking apparatus, as aforesaid, that selectively lights a cigarette inserted into the inhalation port and that discretely collects ashes and cigarette butts from the lit cigarette.

A still further object of this invention is to provide the smoking and drinking apparatus, as aforesaid, that filters smoke generated by a lit cigarette before it is exhausted from the internal air chamber within the apparatus.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
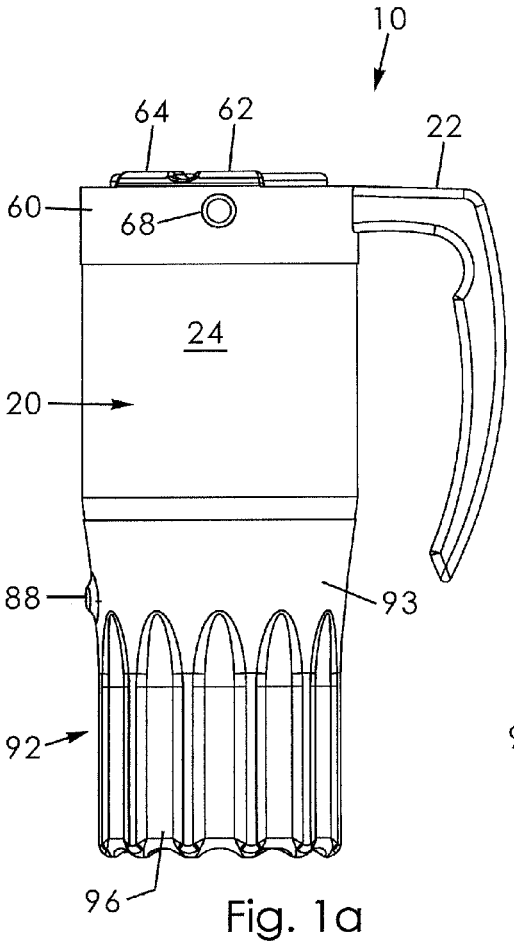
FIG. 1*a* is a side view of a smoking and drinking apparatus according to a preferred embodiment of the present invention.
Figure 1B:
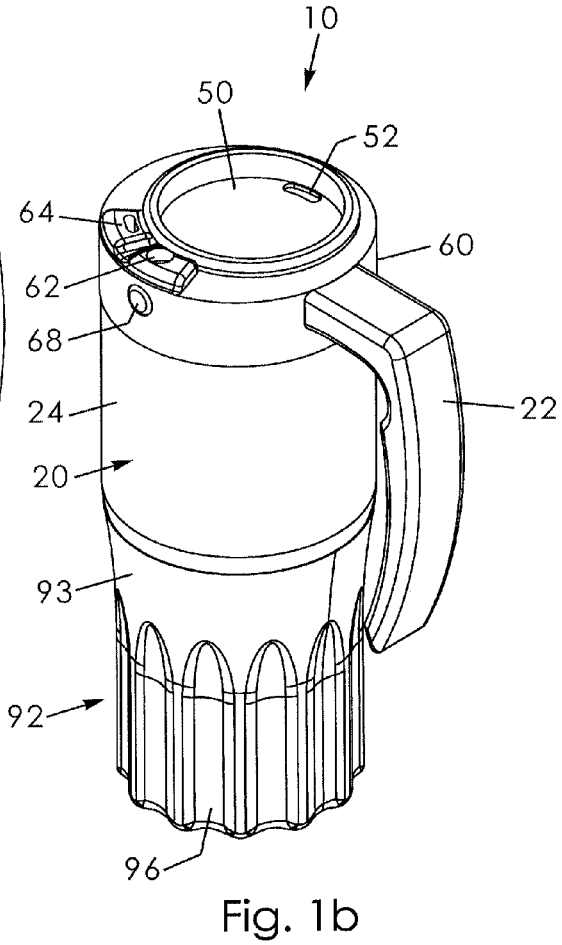
FIG. 1*b* is a perspective view of the apparatus as in FIG. 1*a;*

A smoking and drinking apparatus according to the present invention will now be described with reference to FIGS. 1*a* to 7 of the accompanying drawings. The smoking and drinking apparatus 10 includes a body member 20, a drink reservoir 40, a lighter element 72, a filter 82, a fan 84, and a lower body member 92 as will be described in detail below.

Figure 2:
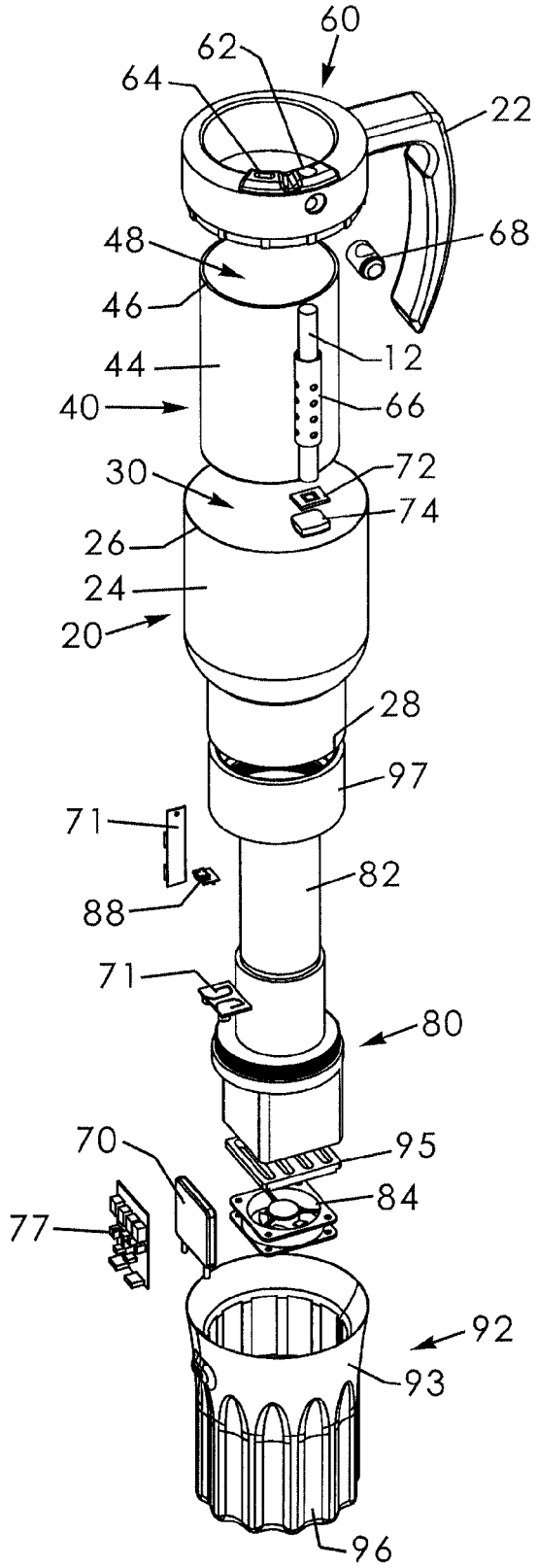
FIG. 2 is an exploded view of the apparatus as in FIG. 1*b;*

The body member 20 generally includes a configuration and appearance of a traditional drinking vessel having a handle 22. More particularly, the body member 20 includes a continuous side wall 24 and defines an interior area that will be referred to herein as an air chamber 34. The body member side wall 24 includes opposed upper 26 and lower 28 edges that define an open top 30 and open bottom 32, respectively (FIG. 2).

The drink reservoir 40 is situated inside the interior area/air chamber 34 of the body member 20. The drink reservoir 40 includes a bottom wall 42 and a continuous side wall 44 extending upwardly from the bottom wall 42. The side wall 44 of the drink reservoir 40 defines a drink chamber, the side wall 44 having an upper edge 46 defining an open top 48 in communication with the drink chamber. The drink reservoir 40 is constructed of a moisture impermeable material such that the drink reservoir 40 may contain a liquid, such as a beverage, to be consumed as described later.

A lid 50 may be selectively and removably coupled to the upper edge 46 of the drink reservoir 40, the lid 50 defining an aperture 52 having a configuration through which a liquid in the drink chamber is selectively removable as with traditional drink containers having lids. The lid 50 is configured to selectively block access to the drink chamber when coupled to the side wall upper edge 46 and to permit access to the drink chamber when removed from the side wall upper edge 46. Further, the side wall 44 of the drink reservoir 40 includes a diameter smaller than a diameter of the side wall 24 of the body member 20. The drink reservoir side wall 44 is inwardly displaced from the body member side wall 44 so as to define the air chamber 34 therebetween.

A bezel 60 (which may also be referred to as a body member upper ring) is coupled to the upper edge 26 of the body member side wall 24 and includes a generally arcuate or ring-shaped configuration. The bezel 60 includes a central bore having a configuration that is complementary to the drink reservoir open top and side wall upper edge 46 such that the bore provides access to the drink chamber of the drink reservoir 40 when the lid 50 is not selectively coupled to the reservoir side wall upper edge 46. The handle 22 may be coupled to the bezel 60 as shown in the drawings although it may be coupled to the body member 20 in some embodiments.

The bezel 60 includes a top wall that defines or includes an inhalation port 62 through which air may be selectively inhaled by a user from the air chamber 34 and an exhalation port 64 through which air may be selectively exhaled by a user into the air chamber 34, the ports being situated adjacent to one another for convenient usage, as will become apparent later. More particularly, the inhalation port 62 is configured to receive a cigarette 12 into the air chamber 34, the inhalation port 62 being configured to appropriately position a received cigarette 12 such that air inhaled by a user through the inhalation port 62 is drawn from and inhaled through the cigarette 12 when the cigarette is lit, as will be described later. It is understood that the inhalation port 62 may include a one-way valve such that air may be withdrawn from the cigarette 12 but not introduced into the air chamber 34.

The exhalation port 64 may include a one-way valve configured to allow air to be introduced into the air chamber 34 but not withdrawn therefrom. In other words, air inside the air collected within the air chamber 34 is not allowed to leave the chamber through the exhalation port 64 but rather only through vents following filtration as will be described later.

A guide tube 66 is positioned in the interior area of the body member 20, the guide tube 66 being in vertical alignment with the inhalation port 62 such that at least a portion of the cigarette 12 inserted into the inhalation port 62 may be received into the guide tube 66 (FIG. 2). Preferably, the guide tube 66 is constructed of a heat resistant material, such as an appropriate type of metal or plastic.

The smoking and drinking apparatus 10 may also include a spring biased release assembly 68 operatively coupled to the guide tube 66 and configured to selectively hold the cigarette 12 in the guide tube 66 and release the cigarette 12 to fall downwardly out of the guide tube 66 (FIGS. 5*a* to 5*d*). As will be described below, the cigarette 12 and burned cigarette butts may be collected in a butt receptacle when released from the guide tube 66.

The smoking and drinking apparatus 10 may include a lower body member 92 that is removably coupled to the lower edges 28 of the body member 20, such as in a threaded engagement, a friction-fit engagement, or other fastening means. In an embodiment in which the lower body member 92 is threadably coupled to the body member 20, a connector ring 97 may be included that is complementary to the lower body member 92 and body member 20 so as to releasably couple them together. In other words, the connector ring 93 is an interface between the two components. The connector ring 97 may have a threaded configuration.

Figure 4A:
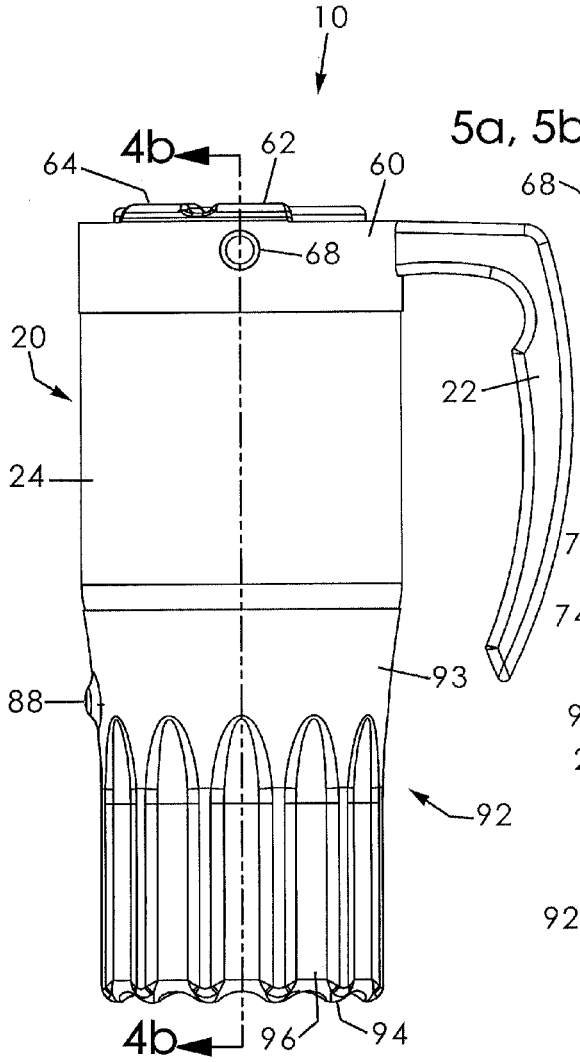
FIG. 4*a* is a front view of the apparatus as in FIG. 1*a;*
Figure 4B:
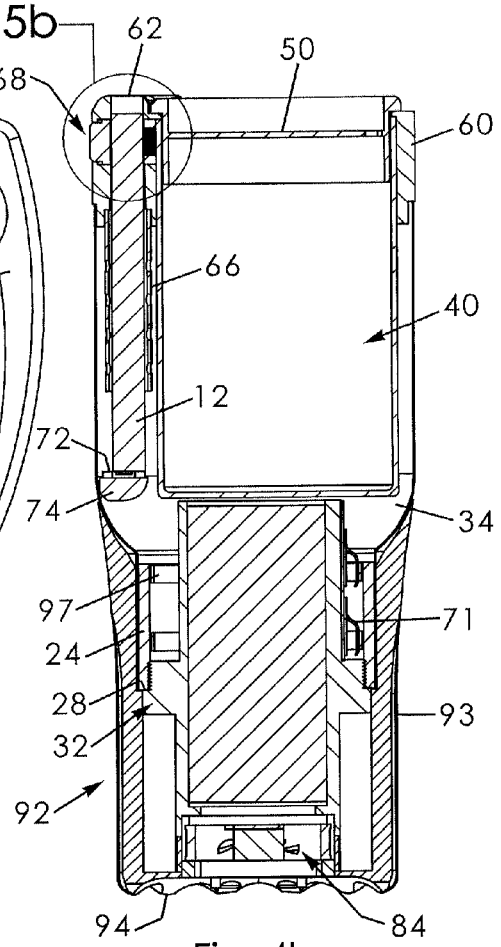
FIG. 4*b* is a sectional view taken along line 4*b*-4*b* of FIG. 4*a;*
Figure 5A:
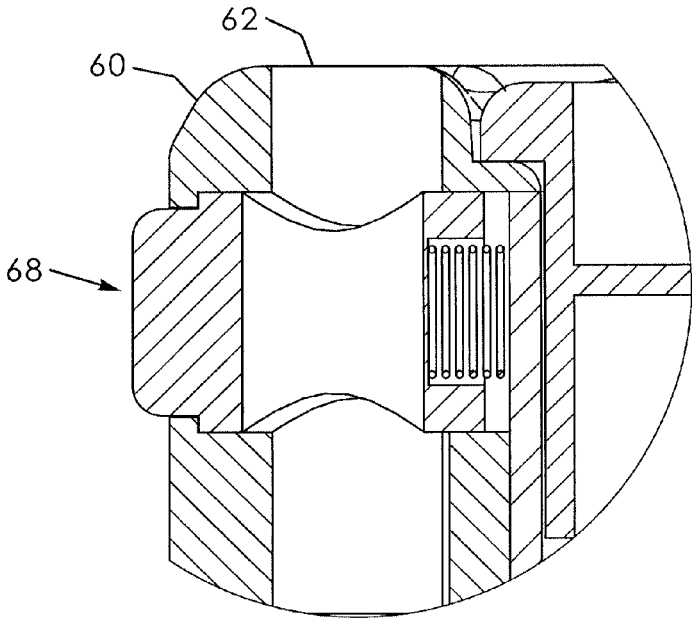
FIG. 5*a* is an isolated view on an enlarged scale taken from FIG. 4*b* showing the coupling assembly in a released configuration.
Figure 5B:
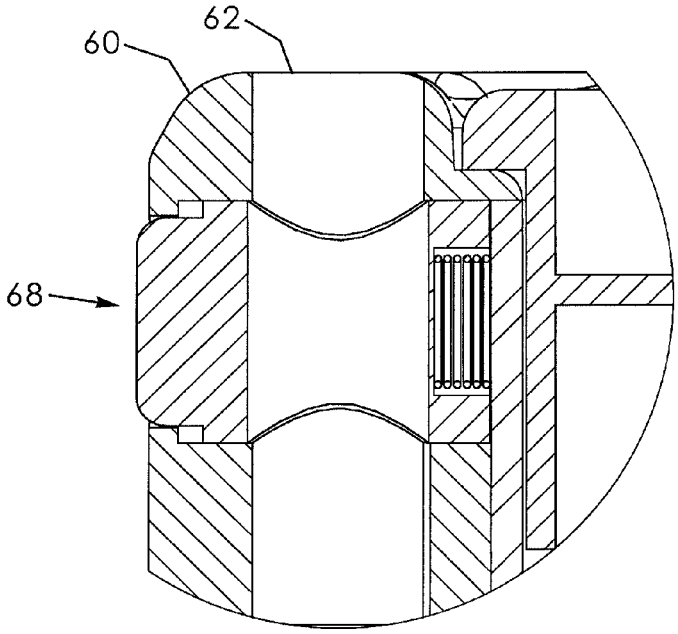
FIG. 5*b* is an isolated view on an enlarged scale taken from FIG. 4*b* showing the coupling assembly in a biased configuration.

A battery 70 may be positioned in the lower body member 92 (FIG. 4*b*). A lighter element 72 may be positioned in the interior area of the body member 20 and electrically connected to the battery 70. It is understood that there may be conductive elements, such as one or more contact boards 71 positioned in the body member 20 and lower body member 92 configured to transfer electricity between the battery 70 and lighter element 72. The lighter element 72 may be positioned downwardly adjacent from a lower end of the guide tube 66 so as to be adjacent a lower end of a cigarette 12 when inserted through the inhalation port 62 and received into the guide tube 66. When energized, the lighter element 72 provides heat sufficient to light the cigarette 12. The lighter element 72 may be supported by a lighter support flange 74 and coupled to the main body side wall 24 accordingly.

An input switch 76 is situated in the body member interior area in electrical communication with the battery 70 and the lighter element 72. Preferably, the input switch 76 may be housed in the bottom of the lower body member 92. The input switch 76 may be a three-way switch 76 having settings for "on," "off," and "light." For instance, the switch 76 may first be moved to an "on" position so that the lighter element 72 may be energized with current from the battery 70 and then to the "light" setting to actuate the lighter element 72 to light the cigarette 12. It is understood that the present apparatus 10 may include an electronics board 77 having electrical circuitry for controlling the various electric components described above.

Figure 3A:
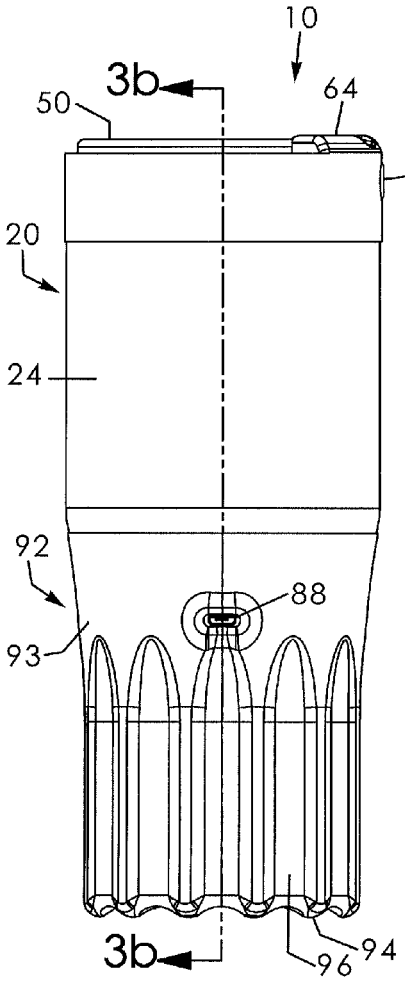
FIG. 3*a* is a side view of the apparatus as in FIG. 1*a;*
Figure 3B:
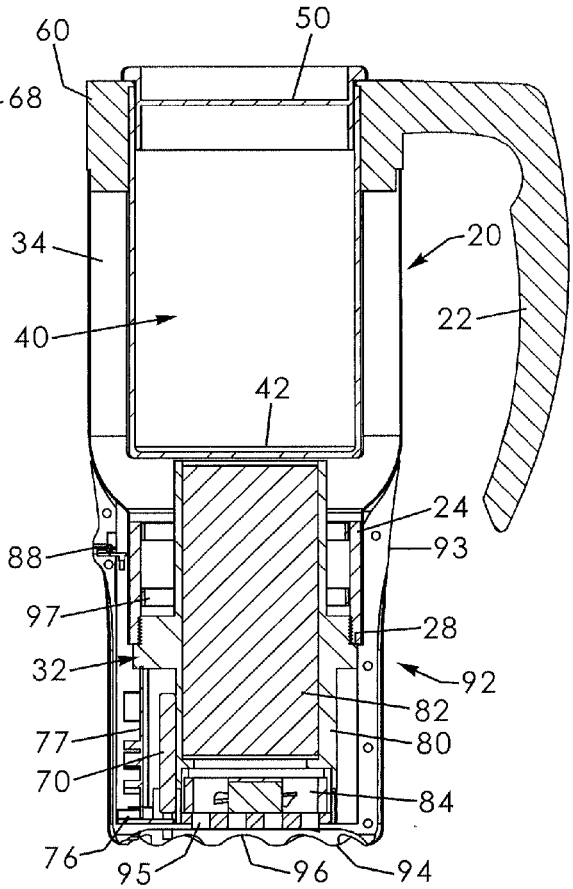
FIG. 3*b* is a sectional view taken along line 3*b*-3*b* of FIG. 3*a;*
Figure 7:
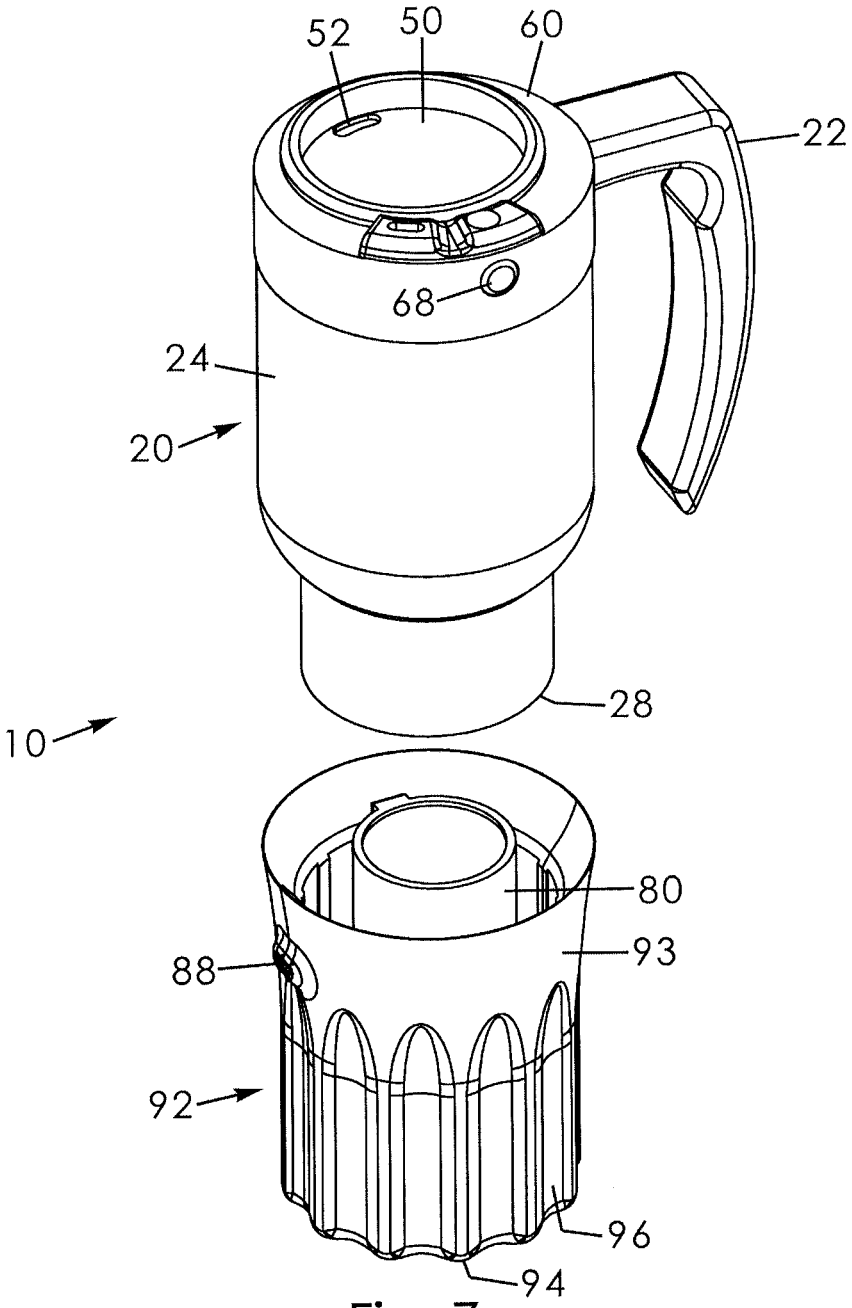
FIG. 7 is a perspective view of the apparatus as in FIG. 1*b* with the body member removed from the lower body member.

A filter housing 80 may also be positioned in the lower body member 92 (FIGS. 3*b*, 4*b*, and 7). Preferably, the filter housing 80 is positioned downwardly adjacent the drink reservoir 40. The filter housing 80 defines an open upper end that is displaced only slightly from the bottom wall 42 of the drink reservoir 40 such that air from the air chamber 34 may be received into the filter housing 80 while butts falling from the cigarette 12 are blocked from entering the filter housing 80. The filter housing 80 may also define an open lower end. A filter 82 may be situated inside the filter housing 80 so as to filter out smoke particles, toxins, and other byproducts of a burning cigarette 12 when air containing such elements is passed through the filter housing 80.

The smoking and drinking apparatus 10 may also include a fan 84 positioned in the lower body member 92 downwardly adjacent the open lower end of the filter housing 80, the fan 84 being configured to draw air from the filter housing 80 through the filter 82 when energized. The fan 84 is electrically connected to the battery 70 and input switch 76 and may be energized when the input switch 76 is in the "on" position. The fan 84 draws air through the filter 82 and then exhausts it out of the air chamber 34 as will be described below.

The cigarette butt receptacle first referred to above may be situated in the lower body member 92 downwardly adjacent and in vertical alignment with the lighter element 72 such that butts from the cigarette, when lit, drop into the butt receptacle. In some embodiments, ashes and cigarette butts may just fall into the lower body member 92 where they may be dumped out when the lower body member 92 is removed from the body member 20.

The lower body member 92 may be configured to contain the filter housing 80, the fan 84, the battery 70, and the input switch 76. Accordingly, the elements situated inside the lower body member 92 may be removed from the air chamber 34 such as to replace the battery 70 or empty the butt receptacle 90. An O-ring (not shown) or other means for sealing between the body member 20 and lower body member 92 may be included (FIG. 2).

Figure 6:
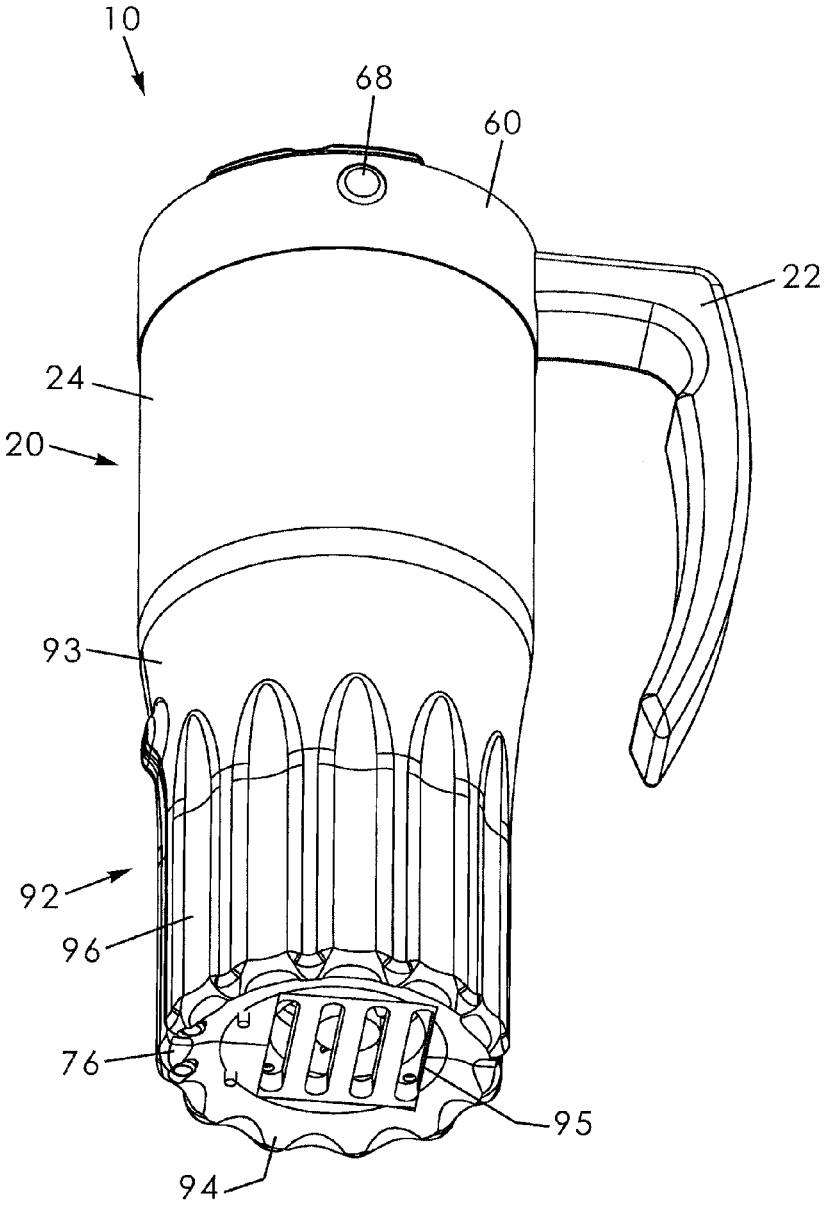
FIG. 6 is a perspective view of the apparatus as in FIG. 1 taken from a lower angle.

Further, the lower body member 92 includes a bottom wall 94 defining at least one vent opening 95 that is configured to enable air to be exhausted out of the air chamber 34 after passing through the filter housing 80 (FIG. 6). It is understood that the vent opening 95 may include a grate member. More particularly, the fan 84 draws air from the air chamber 34 through the filter 82 and then forces the filtered air through the vent opening(s) 95. An exterior surface of the bottom wall 94 of the lower body member 92 may define a plurality of weep vent channels 96 extending radially outwardly from the vent opening(s) 95. Each weep vent channel 96 is configured such that air flowing through the at least one vent opening 95 is not impeded by an obstacle beneath the lower body member, such a the bottom of a drink receptacle in a vehicle. Similarly, an outer surface of a lower body member side wall 93 may also include a plurality of weep vent channels to further enable air passing out of the vent openings 95 to be exhausted without impedance from any surfaces that may be bearing against the lower body member 92. The weep vent channels 96 may be especially desirable if the smoking and drinking apparatus 10 is situated tightly in an automobile cup holder or the like.

In some embodiments, the smoking and drinking apparatus 10 may include a charging plug 88 that may be electrically connected to an electrical source and configured to transfer electrical energy from the charging source to the rechargeable battery 70 (FIG. 6). For instance, the charging plug 88 may be connected to an automobile lighter or another electrical outlet using an appropriate adapter such as a USB cable (not shown).

In some embodiments, some internal components may be surrounded by a heat resistance sleeve (not shown) as an enhanced protection against excessive heat. For instance, the lower body member 92 may include the heat resistant sleeve constructed of a heat resistant material. In other embodiments, the interior surface of the body member side wall 24 and interior surface of the lower body member 92 may include a heat resistant coating.

In use, a beverage may be poured into the drink chamber of the drink reservoir 40 and the lid 50 coupled to the upper edge thereof. The beverage may be consumed by a user in a traditional manner through the lid aperture 52. If smoking is desired, a cigarette 12 may be inserted through the inhalation port 62 and received by the guide tube 66. A proximal end of the cigarette 12 will be immediately adjacent the inhalation port 62 and a distal end of the cigarette will be immediately adjacent the lighter element 72 (FIG. 4*b*) as described above. The lighter element 72 may then be energized when a user actuates the input switch 76 such that the cigarette 12 is lit. A user may then inhale from the inhalation port 62 and, a result, inhale smoke from the lighted cigarette 12. Then the user may exhale into the exhalation port 64 rather than into the ambient air. As a result, no smoke from the cigarette 12 is ever dispensed into the ambient air where it could be smelled or inhaled by other people. In other words, use of the smoking and drinking apparatus 10 is not perceived by other people in proximity to the apparatus 10.

Accordingly, the smoking and drinking apparatus 10 enables a user to smoke in a public place, in his vehicle, around other people who may be sensitive to smoke, or even in areas where smoking may otherwise be prohibited.

It is understood that while certain forms of this invention have been illustrated and described, it is not limited thereto except insofar as such limitations are included in the following claims and allowable functional equivalents thereof.

The invention claimed is:

1. A smoking and drinking apparatus for use by a person to selectively drink a beverage and smoke a cigarette, comprising:

a body member having a continuous side wall defining an interior air chamber configured to retain a cigarette, said body member continuous side wall having upper and lower edges defining an open top and an open bottom, respectively; and a bezel having an arcuate configuration that is mounted to said body member side wall upper edge, said bezel including an inhalation port through which air is selectively inhaled from the cigarette retained in said air chamber and an exhalation port through which air is selectively exhaled into said air chamber;

a lower body member removably coupled to said lower edges of said body member;

a battery situated in said lower body member;

a lighter element positioned in said body member air chamber and in electrical communication with said battery, said lighter element positioned adjacent a distal end of the cigarette when inserted through said inhalation port; and an input switch in electrical communication with said battery and said lighter element, said input switch configured to selectively actuate said lighter element to produce heat capable of lighting the cigarette;

a filter housing positioned in said lower body member, said filter housing defining an open upper end such that air from said air chamber is received into said filter housing and an open lower end;

a filter situated in said filter housing; and a fan positioned in said air chamber downwardly adjacent said open lower end of said filter housing, said fan being electrically connected to said battery and configured to draw air from said filter housing through said filter when said fan is actuated.

2. The smoking and drinking apparatus as in claim 1, further comprising:

an inner reservoir situated in said body member air chamber having a bottom wall and an inner reservoir continuous side wall extending upwardly from said bottom wall so as to define a drink chamber, said inner reservoir side wall having an upper edge defining an open top;

wherein:

said drink chamber is constructed of a water impermeable material configured to contain a liquid;

said inner reservoir continuous side wall defines a diameter smaller than a diameter of said body member, said inner reservoir continuous side wall being inwardly displaced from said body member side wall; and said bezel defines a bore having a configuration that is complementary to said inner reservoir open top so as to permit access to said drink chamber.

3. The smoking and drinking apparatus as in claim 2, wherein said inhalation port is configured to receive a cigarette into said air chamber such that air inhaled through said inhalation port is drawn from the cigarette when lit.

4. The smoking and drinking apparatus as in claim 2, further comprising:

a lid removably coupled to said drink reservoir side wall upper edge and configured to selectively permit or block access to said drink chamber; and said lid defining an aperture configured to communicate said drink chamber with an area outside said drink chamber.

5. The smoking and drinking apparatus as in claim 1, further comprising a guide tube positioned in said air chamber adjacent said inhalation port of said bezel, said guide tube having a heat resistant construction and being configured to receive a cigarette.

6. The smoking and drinking apparatus as in claim 1 further comprising a butt receptacle situated in said air chamber downwardly adjacent and in general vertical alignment with said lighter element such that butts from the cigarette, when lit, fall into said butt receptacle.

7. The smoking and drinking apparatus as in claim 6, wherein said butt receptacle defines an open top such that said butt receptacle may be emptied when said lower body member is removed from said body member.

8. A smoking and drinking apparatus for use by a person to selectively drink a beverage and smoke a cigarette, comprising:

a body member having a continuous side wall defining an interior air chamber configured to retain a cigarette, said body member continuous side wall having upper and lower edges defining an open top and an open bottom, respectively; and a bezel having an arcuate configuration that is mounted to said body member side wall upper edge, said bezel including an inhalation port through which air is selectively inhaled from the cigarette retained in said air chamber and an exhalation port through which air is selectively exhaled into said air chamber;

a lower body member removably coupled to said lower edges of said body member;

a battery situated in said lower body member;

a lighter element positioned in said body member air chamber and in electrical communication with said battery, said lighter element positioned adjacent a distal end of the cigarette when inserted through said inhalation port; and an input switch in electrical communication with said battery and said lighter element, said input switch configured to selectively actuate said lighter element to produce heat capable of lighting the cigarette; and a butt receptacle situated in said air chamber downwardly adjacent and in general vertical alignment with said lighter element such that butts from the cigarette, when lit, fall into said butt receptacle;

wherein said lower body member includes a bottom wall defining at least one vent opening configured to enable air from said air chamber to exit said air chamber after being drawn through said filter housing;

wherein an exterior surface of said lower body member bottom wall defines a plurality of weep vent channels extending radially from said at least one vent opening, each weep vent channel being configured such that air flowing through said at least one vent opening is not impeded by an obstacle beneath said lower body member.

* * * * *